US005711121A

United States Patent [19]

Garver

[11] Patent Number: 5,711,121

[45] Date of Patent: Jan. 27, 1998

[54] PARTITION SYSTEM

[76] Inventor: James A. Garver, 40 W. Mountain Dr., Montecito, Calif. 93108

[21] Appl. No.: 755,095

[22] Filed: Oct. 22, 1996

Related U.S. Application Data

[63] Continuation of Ser. No. 441,535, May 15, 1995, abandoned.

[51] Int. Cl.[6] ..... E04H 1/00

[52] U.S. Cl. ..... 52/239; 16/251; 16/387; 49/239; 49/381; 52/127.12; 52/241

[58] Field of Search ..... 16/251, 387; 49/9, 49/236, 237, 239, 381; 52/34, 35, 127.1, 127.7, 127.12, 238.1, 239, 241, 787.1

[56] References Cited

U.S. PATENT DOCUMENTS

| | | | |
|---|---|---|---|
| D. 46,883 | 1/1915 | McClelland . | |
| D. 51,672 | 1/1918 | Carpenter . | |
| D. 115,144 | 6/1939 | Deravin . | |
| D. 188,180 | 6/1960 | Grayboff . | |
| D. 208,413 | 8/1967 | Ball . | |
| D. 225,635 | 12/1972 | Dowd . | |
| D. 232,172 | 7/1974 | Themis . | |
| D. 232,308 | 8/1974 | Totoonchie . | |
| D. 242,099 | 11/1976 | Casey . | |
| D. 242,100 | 11/1976 | Casey . | |
| D. 246,082 | 10/1977 | Friedrich . | |
| D. 255,196 | 6/1980 | Durrant . | |
| D. 272,113 | 1/1984 | Russell et al. . | |
| D. 278,395 | 4/1985 | Keeler . | |
| D. 290,658 | 6/1987 | Scarpa et al. . | |
| D. 293,981 | 2/1988 | Ball . | |
| D. 304,529 | 11/1989 | Hontz . | |
| D. 305,582 | 1/1990 | Zapf . | |
| D. 318,574 | 7/1991 | Witzig . | |
| D. 321,755 | 11/1991 | Poulson et al. . | |
| D. 333,352 | 2/1993 | Heidmann . | |
| 1,311,229 | 7/1919 | Hughes | 52/239 |
| 1,340,430 | 5/1920 | Wright | 16/251 |
| 2,175,717 | 10/1939 | Kerr . | |
| 2,268,264 | 12/1941 | Nimick et al. | 52/35 X |
| 2,287,079 | 6/1942 | Anderson | 52/239 |
| 2,717,666 | 9/1955 | Morales . | |
| 2,881,876 | 4/1959 | Williams . | |
| 3,013,642 | 12/1961 | Hammitt et al. | 52/238.1 |
| 3,075,235 | 1/1963 | Albinson . | |
| 3,194,362 | 7/1965 | Wargo . | |
| 3,242,619 | 3/1966 | Parsons . | |
| 3,263,370 | 8/1966 | Martinez . | |
| 3,283,453 | 11/1966 | Schooler . | |
| 3,284,968 | 11/1966 | Schooler | 52/239 X |
| 3,284,974 | 11/1966 | Stein | 52/239 |
| 3,327,440 | 6/1967 | Watkins . | |
| 3,348,346 | 10/1967 | Heim et al. . | |
| 3,352,075 | 11/1967 | Werner et al. | 52/239 |
| 3,370,388 | 2/1968 | Dielman . | |
| 3,715,847 | 2/1973 | Straus . | |
| 3,813,836 | 6/1974 | Dielman | 52/239 |
| 3,824,747 | 7/1974 | Zehner, Jr. . | |
| 3,842,556 | 10/1974 | Brendgord . | |
| 3,999,353 | 12/1976 | Dielman . | |

(List continued on next page.)

FOREIGN PATENT DOCUMENTS

| | | | |
|---|---|---|---|
| 401102 | 8/1909 | France | 16/387 |
| 3719829A1 | 12/1988 | Germany . | |
| 182911 | 6/1936 | Switzerland | 49/239 |

*Primary Examiner*—Carl D. Friedman
*Assistant Examiner*—Kevin D. Wilkens
*Attorney, Agent, or Firm*—Darby & Darby, P.C.

[57] ABSTRACT

A cubicle forming partition system has a construction which permits the use of wall panels made entirely from a cost effective volume of solid surface plastic sheets. The wall panels are rigidly secured in spaced relation from a room floor by mounts which positively engage forward and rear edge portions of the wall panels without penetrating or interrupting either of the opposed, continuous wall forming surfaces of the wall panels. Steel reinforcements in a composite pilaster and metallic hardware for mounting wall and door panels are concealed from exposure to airborne moisture and contaminants for enhancing durability of the partition system when used in moisture rich environments.

19 Claims, 5 Drawing Sheets

OTHER PUBLICATIONS 4,048,775 9/1977 Dielman .
4,258,856 3/1981 Marling .
4,269,005 5/1981 Timmons .
4,388,783 6/1983 Logie .
4,437,278 3/1984 Thomas, Jr. .
4,478,019 10/1984 Thompson, Jr. .
4,593,508 6/1986 Curatolo .
4,881,353 11/1989 Braendel et al. .
4,928,465 5/1990 Del Castillo Von Haucke .
5,045,636 9/1991 Johnasen et al. ..... 49/239 X
5,097,643 3/1992 Wittler .
5,193,308 3/1993 Davidian .
5,363,612 11/1994 Erickson .
5,363,620 11/1994 Liu .
5,367,844 11/1994 Diedrich .
5,592,787 1/1997 Ophardt ..... 52/34

PARTITION SYSTEM

This is a continuation of U.S. patent application Ser. No. 08/441,535, filed May 15, 1995, and now abandoned.

FIELD OF THE INVENTION

The present invention relates generally to wall partitions and doors for assembling cubicles of the type used commonly, though not exclusively, in toilets, bathrooms, and dressing facilities. The invention relates more particularly to a partition system construction which enables the use of thin wall, solid surface wall panels and steel reinforced composite pilasters also made of solid surface panels.

BACKGROUND OF THE INVENTION

A wide variety of wall panel constructions currently are available for use as dressing room and bathroom partitions. Typically, a wall panel construction consists of a number of spaced apart partitions which are cantilevered along a rear edge from the wall of a room and occasionally are also supported on the floor at a forward end by an end pillar or pilaster. Privacy doors are suspended from an end pillar where it is desired to control access into or out of a cubicle defined by a pair of adjacent partitions. The major types of commonly used wall panel constructions are categorized by the type of material from which the various panels are formed. For instance, existing materials used for the various wall, pilaster, and door panels include metal with a baked enamel finish, plastic laminate, stainless steel, solid phenolic, and solid plastic panels. Material properties of a wall panel construction dictate the applications for which the construction is best suited as well as those application for which a particular wall panel construction is a poor candidate.

Baked enamel metal panel constructions consist of 20 to 22 gauge galvanized steel wall panels and door panels with a honeycomb core. The core is glued to the metal skins and the edges are covered with a locking cap molding. The finish of these panels is a baked on enamel. The advantage of this type of panel construction is low cost. However, it is very susceptible to rusting, corrosion and vandalism. In addition, the finish can be scratched easily and the metal can be dented.

Stainless steel panels have a construction similar to that of baked enamel panels with the exception that stainless steel sheets are used in place of the galvanized steel. This provides some advantages, but also adversely increases the cost of the panel construction. Like baked enamel panel constructions, stainless steel panel constructions are susceptible to denting. Moreover, there are several commercial cleaning solutions that will cause stainless steel to corrode.

Plastic laminate panel constructions are made from 0.050 thick plastic laminate similar to FORMICA®. This laminate is applied to a core of particle board across both faces as well as the edges. In a high moisture environment the cores will expand and cause the laminate to come loose from the core.

Solid core phenolic panel construction are typically constructed from a compression molded phenolic core with a melamine surface, that is, a piece of plastic laminate that is anywhere from ½ to 1 thick with a decorative laminate on both sides. Solid plastic panel constructions now in use have door and side panels made of single sheets of compression molded high density polyethylene (HDPE).

These door and wall sized sheets are made of single sheets of material which necessarily are quite large in order to accommodate the stress concentrations induced by existing panel mounting hardware, such as threaded fasteners which transversely penetrate the wall defining surfaces of a wall panel or which pass through openings formed along the edge of wall panel. Moreover, the required volume of plastic (as reflected in the thickness and overall dimensions of a plastic wall panel necessary to produce a construction having an acceptable degree of strength and rigidity) in a wall panel generally has proved to be cost prohibitive. Fortification of lighter weight solid plastic panels with steel reinforcements to date has introduced the problems discussed above relative to baked enamel metal panel constructions, namely, susceptibility to rusting, corrosion and denting.

Thus, there is a need for an improved partition system which will overcome the above limitations and disadvantages.

OBJECTS OF THE INVENTION

It is a general object of the present invention to provide a wall partition system which will include improvements and innovations directed toward the above discussed problems.

It is a further object of the present invention to provide a wall partition system of the above character having a construction which permits the use of wall panels made entirely of a thin wall, solid surface plastic panels.

It is a further object of the present invention to provide a wall partition system of the above character having wall panels which are approximately one-half inch thick.

It is a further object of the present invention to provide a water resistant wall partition system of the above character which is adapted for use in a moisture rich environment, such as in toilet facilities, showers and locker rooms.

It is a further object of the invention to provide a wall partition system of the above character having steel reinforced composite pilasters in which the steel is substantially concealed from exposure to airborne moisture.

It is a further object of the invention to provide a wall partition system of the above character in which steel U-channels are adhesively secured to forward and rear edge portions of a wall panel for positively engaging the wall panel without penetrating either of the opposed, wall forming edges of the wall panel.

It is a still further object of the invention to provide a wall partition system of the above character in which an elongated plastic shroud extends vertically along each side of the wall panel at the rear and forward edges thereof for substantially concealing the metal U-channels from exposure to airborne moisture and contaminants and for presenting a neat, covered appearance.

It is a still further object of the present invention to provide a wall partition system of the above character having a steel reinforced composite pilaster in which the forward edge of a plastic wall panel is rigidly secured to a metal reinforcing plate disposed within the pilaster.

It is a further object of the present invention to provide a wall partition system of the above character having a steel reinforced composite pilaster in which one or more steel plates are disposed between a pair of adjacent upright plastic panels; the pilaster panels preferably being are made of poly-methyl-methacrylate and each is approximately one-half inch thick.

It is a further object of the present invention to provide a wall partition system of the above character having a steel reinforced composite pilaster in which an internal metal reinforcing plate extends through at least a portion of the height of the pilaster and has an exposed lower end which is rigidly secured to the threaded end of one or more bolts which extend upwardly from an existing floor structure.

It is a further object of the present invention to provide a wall partition system of the above character in which the exposed lower end of a steel pilaster reinforcing plate has an integral footer plate with a slotted opening for receiving the distal ends of bolts which extend upwardly from an existing floor structure.

It is a further object of the present invention to provide a wall partition system of the above character in which a water resistant boot extends between the bottom of pilaster panels and the room floor for substantially concealing the exposed lower end of a metal reinforcing plate and footer plate from exposure to airborne moisture and contaminants.

It is a further object of the present invention to provide a wall partition system of the above character in which a solid surface type plastic door panel is mounted to a composite pilaster by hinge structure having a first metal hinge plate embedded between adjacent plastic layers of the pilaster and a second hinge plate secured to one surface of the door panel; the first and second hinge plates having laterally extending arms with cooperating arms for defining a vertical axis about which the door panel is rotatable for selectively controlling access to a cubicle.

It is a further object of the present invention to provide a wall partition system of the above character in which an elongated plastic shield extends vertically along one side of door panel and substantially conceals the second hinge plate from exposure to airborne moisture.

It is a further object of the present invention to provide a partition system as in the preceding objects which is particularly suited for implementation using poly-methyl-methacrylate sheet sold under the trademark CORIAN® by the DuPont Company.

SUMMARY OF THE INVENTION

The partition system of the present invention offers a improvements and performance advances in a wall partition system for assembling a series of adjacent cubicles.

The present invention is premised generally on the concept of using wall panels made of solid surface plastic panels in such a construction so as to achieve what is believed to be an optimal balance of strength, durability, performance and cost effectiveness. In addition, the present invention is so designed that despite the use of metal reinforcing components which heretofore have introduced unacceptable performance characteristics in panel constructions utilized in a moisture rich environment, cubicles formed with the partition system according to the present invention are versatile and ideally suited for such "wet" applications as toilets, showers and locker rooms.

As used herein, plastic refers to solid surface materials which are made of an integrally formed sheet of plastic of substantially uniform composition throughout and excludes laminates and other laid-up or built-up structures.

Such solid surface materials are further characterized as having color and performance characteristics that are the homogeneous or uniform throughout, having the same properties through its entire cross section and are typically made of acrylic or polyester with a combination of various fillers. Examples of such solid surface materials include: CORIAN® by Dupont Company; AVONITE® by Avonite Inc.; GIBRALTAR® WILSONART® by the Ralph Wilson Plastics Company; SORREL® by the Formica Company; and FOUNTAINHEAD® by Nevermar Corporation.

Preferably, the present invention is made of CORIAN® sheet, although any of the solid surface materials can be substituted.

More particularly, the present invention provides a partition system for defining one or more adjacent cubicles along the wall of a room with a plurality of spaced partition forming structures. Each partition has solid plastic wall panels which are generally rectangular in horizontal section and are arranged to extend forwardly from and in substantially normal relation with the room wall. A pilaster is supported vertically from the floor of the room for holding the forward edge of the wall panel in spaced relation from the room floor. The room wall supports the rear edge of the wall panel.

Specifically, structure for mounting a wall panel to a pilaster and room wall includes a pair of elongated metal U-channels. The trailing edge of the wall channel is received in one of the U-channels and the U-channel is adhesively secured thereto. A plurality of fastener receiving openings are formed in the U-channel for rigidly securing the wall panel to existing structure in the room wall. The forward edge of the wall panel is adhesively secured in the other of the U-channels. In this way, the U-channels positively engage the wall panel along the length of each U-channel without interrupting or penetrating either of the wall forming surfaces of the panel. Since stress concentrations typically associated with localized fastener connections or mounting holes are eliminated, the required thickness of the wall panel in the present construction advantageously is reduced from previous partition systems.

The pilaster has a composite construction which includes a pair of adjacent plastic panels and a multiplicity of internal steel reinforcing plates. A first reinforcing plate is adhesively secured in a recess formed between the adjacent plastic panels and has a series of vertically aligned threaded openings aligned with openings in the rearmost plastic panel. Fastener receiving openings in the U-channel secured to the forward edge of the wall panel are aligned with the openings in the reinforcing plate and threaded fasteners are inserted therethrough for rigidly securing the plastic wall panel to the steel reinforced pilaster.

It can be seen, therefore, that despite the exclusive use of plastic in the wall panel, the weight of the partition is reliably supported with metal-to-metal connections at the rear and forward edges of the wall panel without unduly subjecting the panel to concentrated support forces or localized stresses.

A second reinforcing plate extends at least partially through the height of the pilaster and has an exposed lower end extending below the plastic pilaster panels for rigidly securing the pilaster to the floor. Particularly, the lower end of the second reinforcing plate has an integral widened footer plate with a pair of laterally openings slots for receiving the threaded end of one or more bolts which extend upwardly from an existing floor structure. The slots accommodate errors in installation of the bolts and permit lateral adjustment of the pilaster location. A plurality of cooperating adjusting nuts on each bolt permit vertical adjustment of the footer plate and leveling of the pilaster.

A plastic door panel is hung from one of the pilasters by means of an inventive steel hinge structure for selectively controlling access through an ingress opening formed between a pair of adjacent pilasters. The hinge structure has a steel hinge plate which extends vertically between the two plastic panels in the pilaster and thereby serves to provide still further reinforcement of the composite pilaster. The hinge plate has a number of integral arms which extend outwardly of the pilaster and engage similar arms integral with a second hinge plate attached to one side of the door panel. Outer ends of each arm have a generally cylindrical barrel with a central opening. The central openings in the barrel on each pair of corresponding hinge plate arms are aligned and receive a hinge pin for defining a vertical axis about which the door panel rotates. Operation of the door is regulated by a latch and striker on the door panel and a keeper attached to the adjacent pilaster as well as a bumper stop attached to the pilaster.

In addition to the use of plastic and wall and door panels, the partition system is especially adapted for use in high moisture environments due to the manner in which the various metal components are concealed within the panel construction. Elongated plastic shrouds extend vertically along each side of the wall panel at the rear and forward edges thereof and substantially conceal the U-channels and related fasteners from exposure to airborne moisture and contaminants. Edges of the shrouds are further sealed with silicon caulk to prevent ingress of water or dirt into the mounting structures.

The metal reinforcing plates located within the composite pilasters are inherently concealed by the surround plastic panels. Further, the reinforcing plates (and U-channels) preferable are made of stainless steel.

A plastic boot slides along the pilaster and over the footer plate and exposed lower portion of the second reinforcing plate. Edges of the boot are further sealed with silicon caulk to prevent ingress of water or dirt into the floor mounting structure.

In summary, the non-intrusive U-channel mounts for the wall panels and the steel reinforcements and panel mounts reduce the required thickness (and volume) of plastic so that cost is minimized and the use of solid plastic wall panels in a partition system is enabled. Superior durability and maintenance characteristics in a plastic wall panel have been realized in panels made of poly-methyl-methacrylate marketed under the trademark CORIAN® by DuPont De Nemours & Co. of Wilmington, Del. Not only does the use of plastic wall panels provide the inherent advantages of plastic itself, but when taken in conjunction with the numerous water impervious shrouds and boots utilized in the present invention, contributes to the unrivaled versatility and robustness of the disclosed partition system.

These and other features and objects of the invention will become apparent from the following summary and detailed description when taken in conjunction with the accompanying drawings and claims.

DETAILED DESCRIPTION OF THE PREFERRED EMBODIMENT

Figure 1:
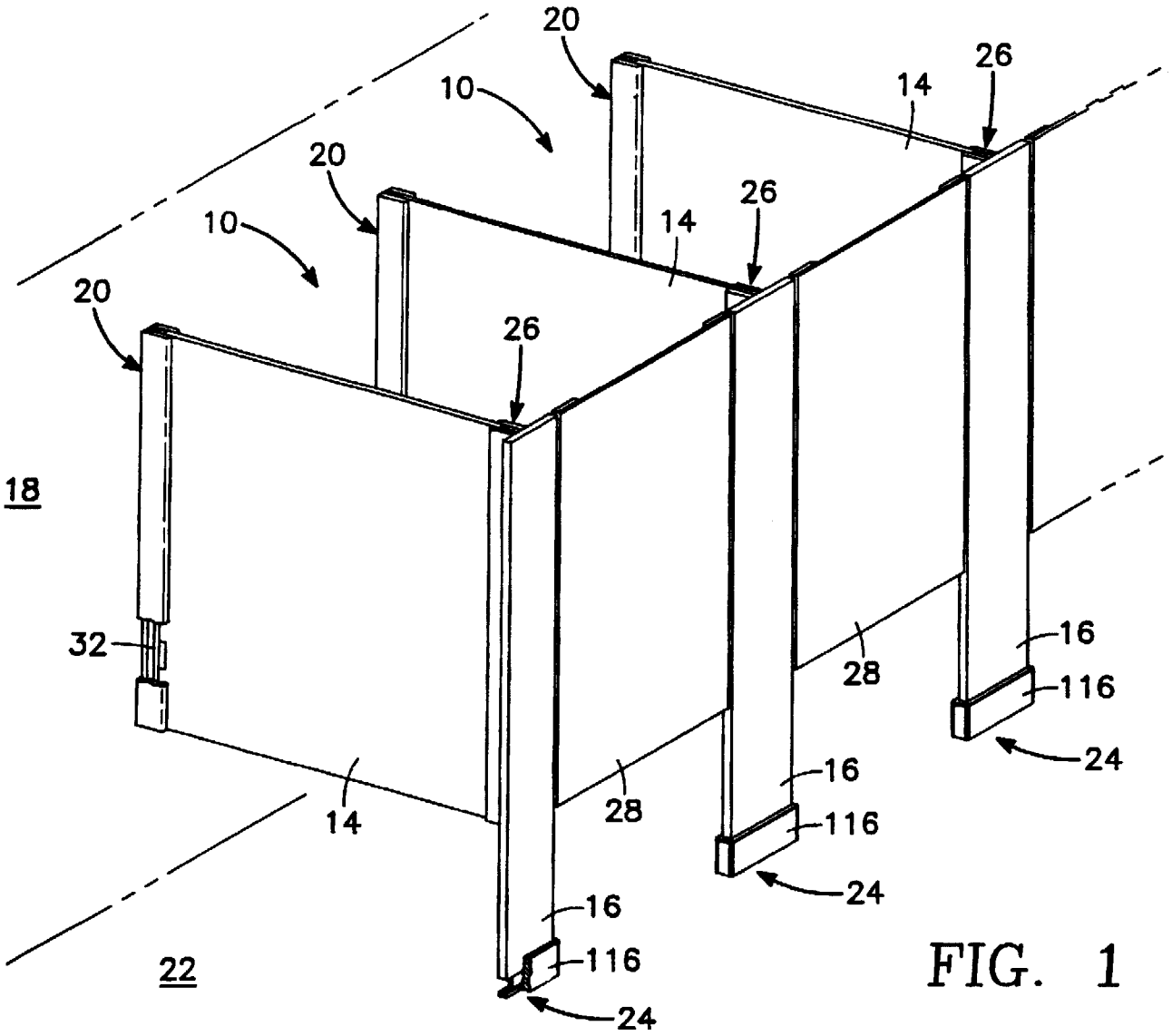
FIG. 1 is a perspective view of a plurality of adjacent cubicles assembled with a partition system constructed in accordance with the present invention.

Referring first to FIG. 1, adjacent cubicles 10 formed with the partition system of the present invention are shown in assembled detail as would be used in bathroom and dressing facilities or other facilities wherein a modicum of privacy is required.

The partition system shown in FIG. 1 has a number of spaced partition forming structures each of which includes a wall panel 14 and a substantially vertical wall portion member defining a pilaster 16. The number of partitions depends, of course, on the desired number and size of cubicles 10 to be formed in a particular facility. As shown, the wall panel 14 of each partition extends forwardly from and in substantially normal relation with a vertical wall 18 of a room in which the cubicles 10 are formed. The rear vertical edge of each wall panel 14 is attached to the vertical wall 18 by mounting means 20 described below. The pilaster 16 of each partition forming structure extends transversely of a corresponding wall panel 14 and is supported on the floor 22 of the room and rigidly secured thereto by means of mounting structure 24. The front vertical edge of each wall panel 14 is attached to a corresponding pilaster 16 by means of mounting means 26 and thereby is held in spaced relation to the room floor 22. A door panel 28 is supported on a pilaster 16 and rotates about a vertical axis in known manner to selectively control access into and out of a cubicle 10.

Referring now to FIGS. 2–5, mounting means or assembly, designated generally by reference numeral 20, for rigidly securing the trailing edge 30 of a wall panel 14 to the room wall 18 is shown in greater detail. An elongated metal U-channel 32 is placed over the trailing edge 30 of the wall panel 14 and secured thereto by means of a suitable adhesive such as WELDON 10™. A rearwardly opening metal U-channel 34 is affixed to the wall 18 with a plurality of vertically spaced threaded fasteners 36 which define a securing structure for the U-channel 34. Cap screws 38 define an adjustable fastening structure and connect U-channels 32 and 34 in a manner best illustrated in FIG. 3 to rigidly secure the wall panel 14 in spaced relation to the wall 18.

More particularly, each threaded end of a cap screw 38 is inserted through an opening in the web portion 40 of a U-channel 34 and secured thereto by means of adjuster nuts 42 and 44. Adjuster nuts 44 preferably are welded to the inner face of web portion 40 during manufacture to facilitate installation of cap screws 38. The head end 46 of each cap screw 38 is received in a slotted opening 48 in the web portion 50 of the U-channel 32 and secured thereto by means of a clamp nut 52. Access to the head end 46 of a cap screw 38 during assembly of the cubicles 10 is achieved by means of access openings 54 formed in the rear edge 30 of a wall panel 14 and aligned with the slotted openings 48 in the U-channel 32.

Figure 3:
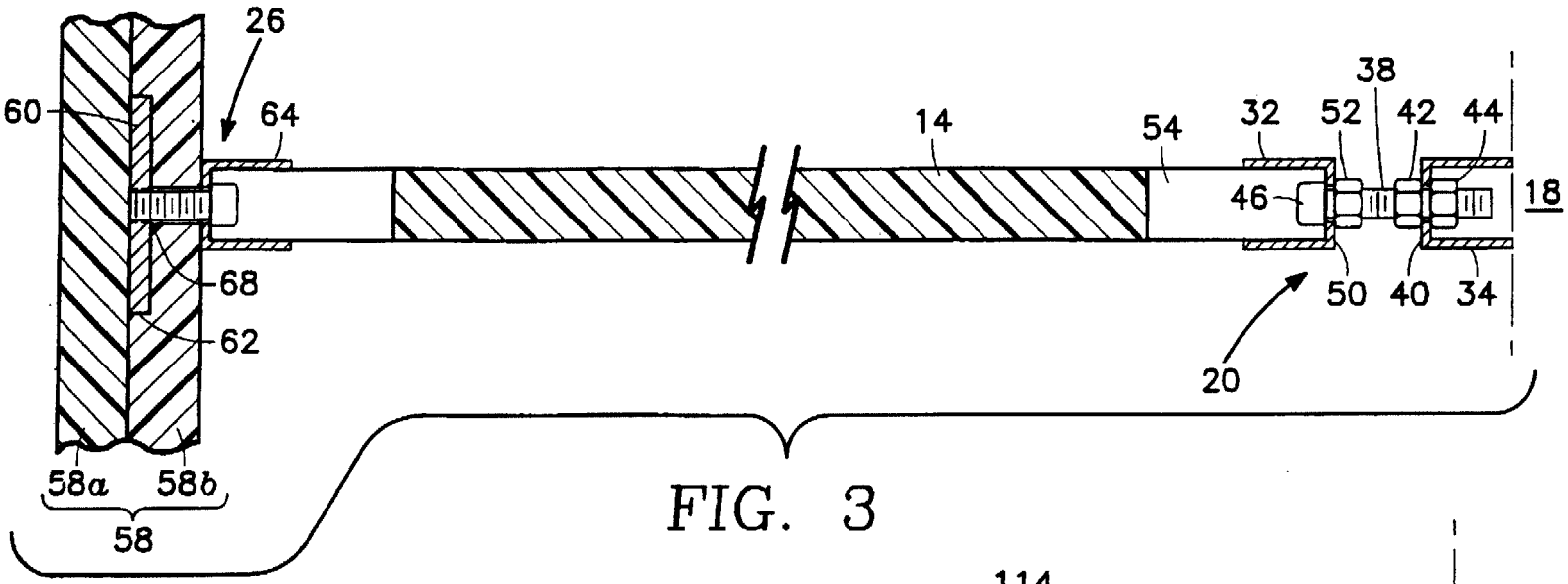
FIG. 3 is a vertical cross sectional view taken through the structure of FIG. 2 taken along the lines 3—3 thereof.
Figure 4:
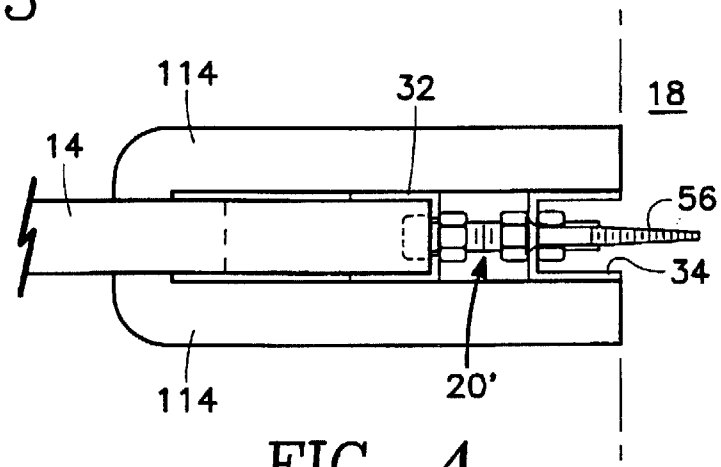
FIG. 4 is a fragmentary view of the structure shown in FIG. 3 showing an alternative connector for securing a wall panel to a vertical wall and trim for concealing wall mounting hardware in accordance with present invention.

An alternative mounting means 20' is illustrated in FIG. 4 wherein lag bolts 56 replace fasteners 36 and cap screws 38 and perform the dual function of securing U-channel 34 to wall 18 and rigidly connecting U-channel 32 to U-channel 34. Adjuster nuts 42, 44 and clamp nut 52 function identically as disclosed above with respect to the embodiment illustrated in FIG. 3.

An advantage of the disclosed wall mounting construction is the ability to rigidly secure the base or rear edge 30 of the wall panels 14 without penetrating the oppositely directed wall defining surfaces of the panels with transverse fasteners or otherwise interrupting the smooth, continuous character of the wall surfaces with openings for receiving such fasteners. Instead, an adhesive bond between the spaced legs of the U-channel 32 and the rear edge 30 over the length of the U-channel provides a rigid, positive connection between the panel 14 and the U-channel 32 without inducing the stress concentrations or material compromises associated with the use of penetrating fasteners.

Further, the mounting means 20 is well adapted to multiple methods for optimally aligning a wall panel 14 plumb. That is, if the wall 18 is not plumb, adjuster nuts 42, 44 and clamp nut 52 are manipulated to vary the working lengths of cap screws 38 along the height of wall panel 14 and achieve a proper suspension of the wall panel. Alternatively, U-channel 34 can be shimmed by inserting variable thickness shims between the U-channel 34 and the wall 18 to achieve a desired suspension of the wall panel 14.

Figure 2:
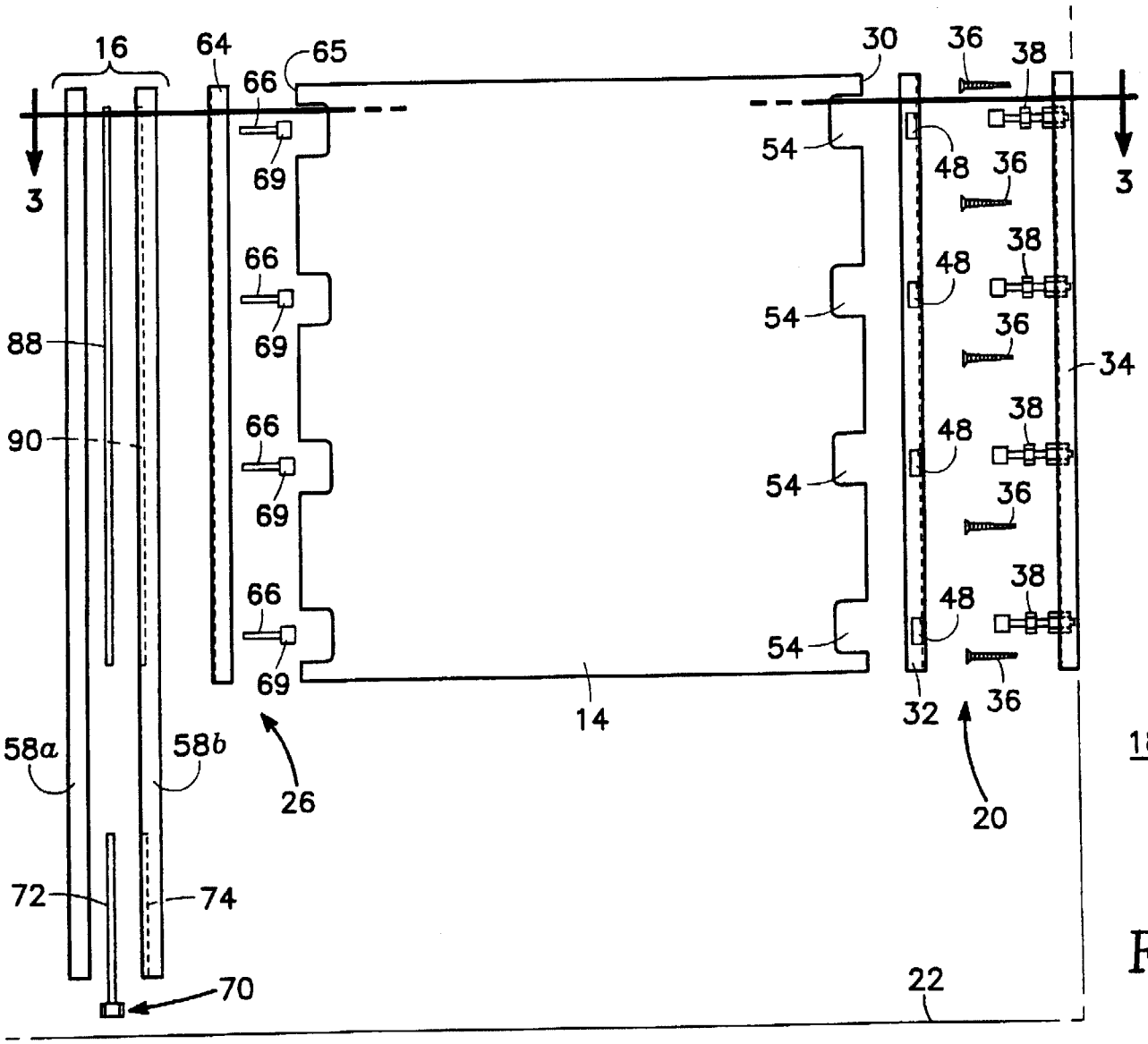
FIG. 2 is an exploded side view of an individual partition of the partition system of FIG. 1.

Mounting structure or means 26 for rigidly securing a pilaster 16 to a wall panel 14 is shown in FIGS. 2 and 3 wherein it is illustrated that a pilaster 16 comprises an upright composite pillar 58 in the form of a generally vertical wall portion member and formed of back-to-back panels 58*a*, 58*b* of similar material with a metal plate 60 disposed in an interior recess 62 formed therein for reinforcing the pilaster 16. Pilaster panels 58 are adhesively bonded to each other by conventional means.

An elongated metal U-channel 64 is placed over the forward edge 65 of a wall panel 14 and secured thereto by means of a suitable adhesive such as WELDON 10™. Threaded ends of cap screws 66 are engaged in vertically spaced threaded openings 68 formed in the metal reinforcing plate 60 and partially tightened to provide a slight clearance between the cap end 69 and the pilaster 16. The cap end 69 of each cap screw 66 then is received in a slotted opening in the web portion of the U-channel 64 and tightened against the web. Access to the head end 69 of the cap screw 66 during assembly of the cubicles 10 is achieved by means of access openings 67 formed in the forward edge 65 of a wall panel 14 and aligned with the slotted openings in the U-channel 64.

As described above relative to mounting means 20, the disclosed wall mounting construction, and in particular the adhesive connections utilized in mounting means 26, advantageously provides for a positive yet relatively low stress connection between the forward edge 65 of the wall panels 14 and the pilasters 16. Also, since the forward edge of the wall panels 14 is supported by the pilasters 16, stresses which occur in the base or root of present cantilevered wall panels are eliminated and the mounting means 20 can be of reduced width without compromising the integrity of the wall connection. The width of the U-channels 32 and 34 (that is, the width of the web portions of the U-channels 32 and 34) is substantially equal to the thickness of the wall panels 14 and the mounting area required for installation of the U-channels 34 is minimized. Reduced mounting area is particularly advantageous when shimming the U-channel 34 for achieving a true vertical suspension of the wall panels 14. In one embodiment, the width of the U-channel 34 is approximately one-half (½) inches.

Figure 5:
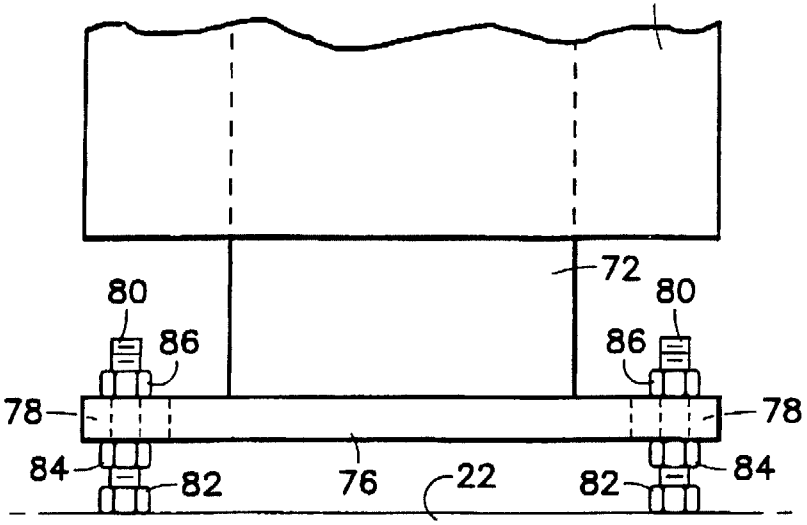
FIG. 5 is a fragmentary view showing the base of a pilaster and structure for attaching the pilaster to the floor in accordance with the present invention.
Figure 6:
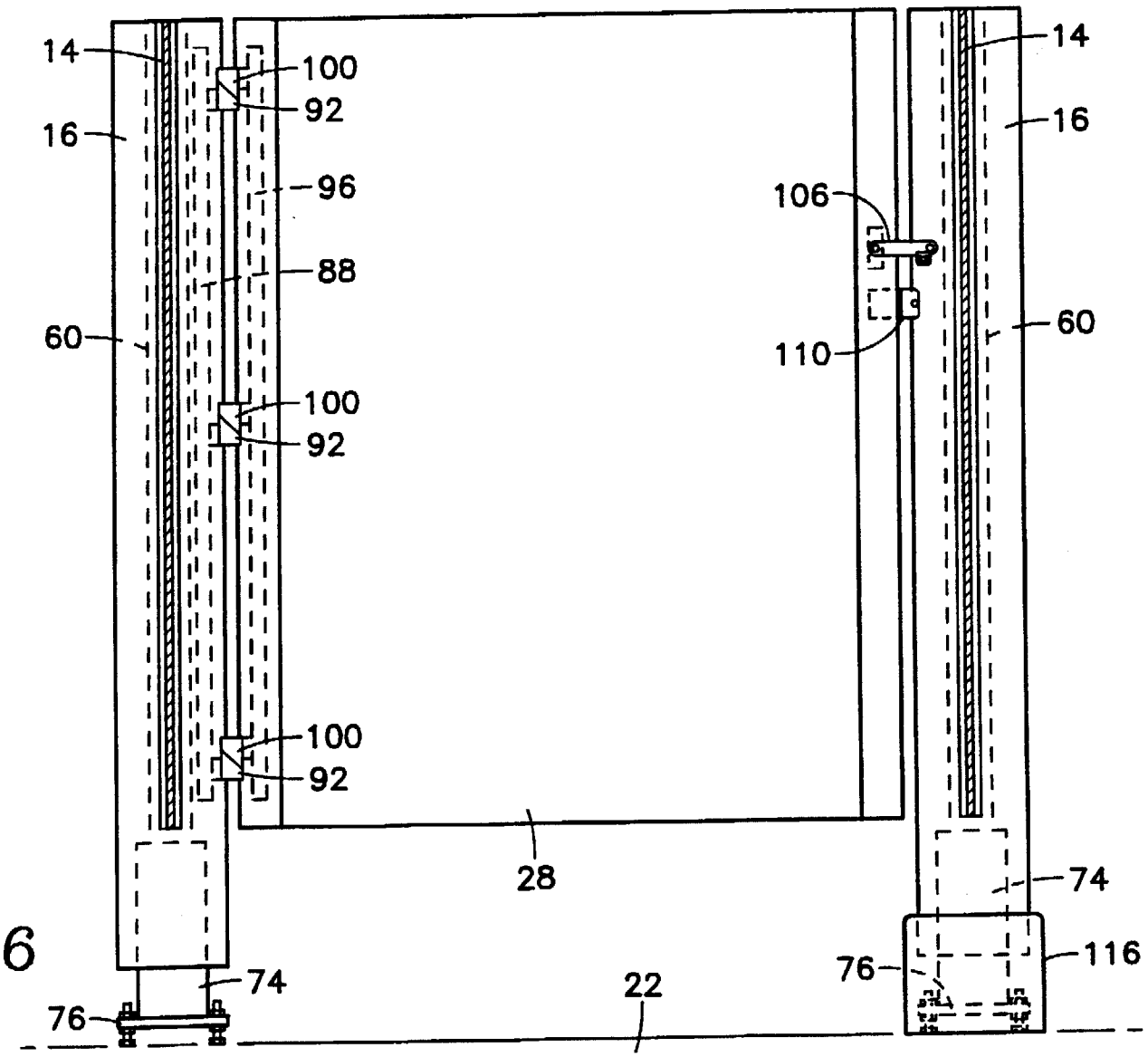
FIG. 6 is a front elevational view showing an assembled cubicle of FIG. 1 with the door in the closed position thereof.
Figure 11:
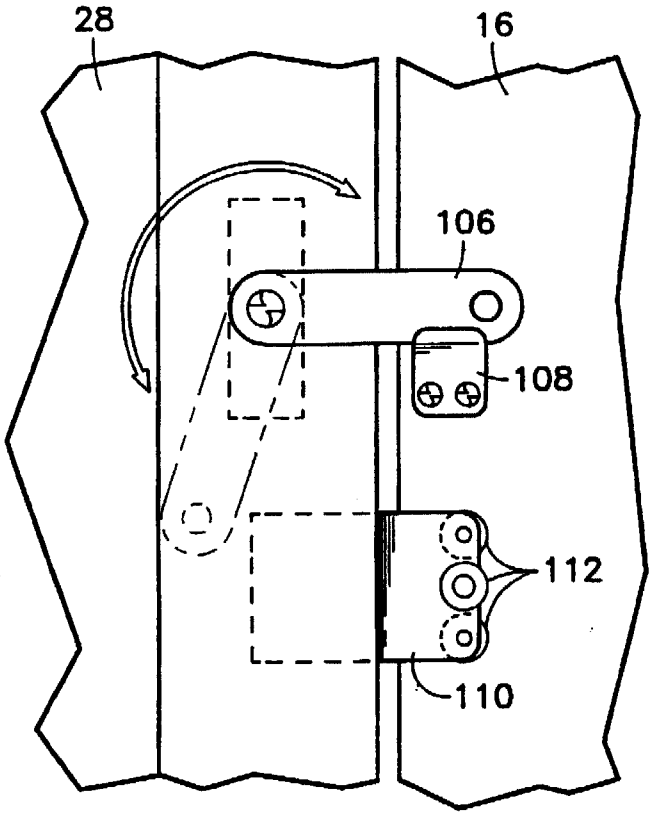
FIG. 11 is a schematic diagram showing the operation of the door latch and striker used in the prevent invention.
Figure 10:
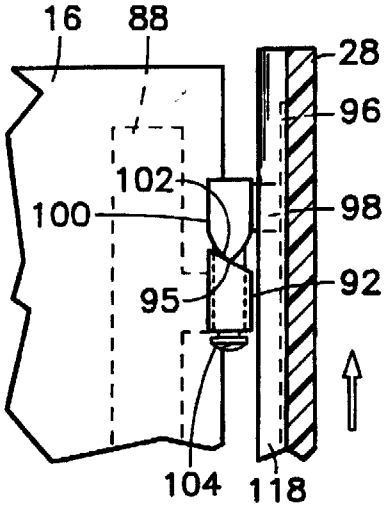
FIGS. 9 and 10 are fragmentary perspective views showing the hinge structure and the position of the door corresponding to FIGS. 7 and 8.
Figure 8:
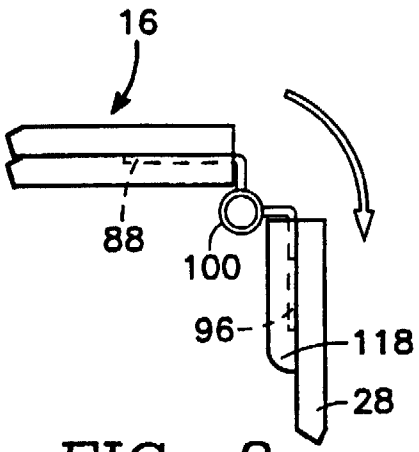
FIGS. 7 and 8 are schematic diagrams showing the operation of the hinge for opening and closing the door as used in the partition system of this invention.
Figure 9:
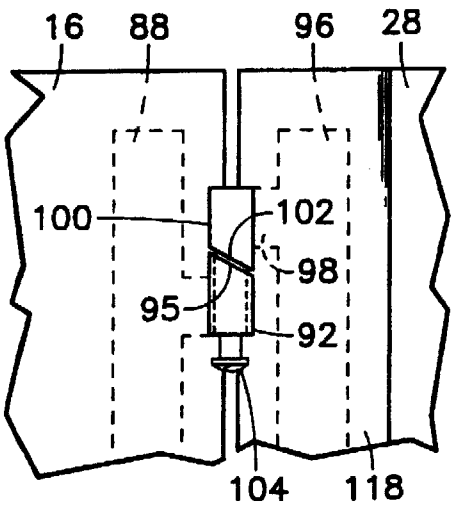
Figure 7:
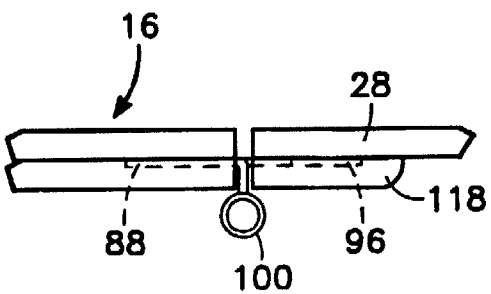

An engagement assembly 24 for securing the base of the pilasters 16 to existing structure in the room floor 22 is shown in FIGS. 2, 5 and 6. A metal reinforcing plate or base plate 70 has a vertically extending portion 72 disposed in a recess 74 intermediate the adjacent pilaster panels 58. An exposed lower end of the base plate 70 terminates in a widened footer plate 76 having a pair of laterally opening slots 78 for receiving the threaded ends of a pair of upstanding bolt studs 80. Bolt studs 80 are of conventional design and are installed in the floor 22 or other suitable structure prior to assembly of the present partition system. Adjuster nuts 82 and 84 and clamp nuts 86 secure the footer plate 76 in a desired relation above the floor 22.

The noted construction of footer plate 76 provides important features of the present partition system. Because the footer plate 76 has elongated slots 78 for receiving the bolt studs 80, a degree of adjustability is inherent in the design. As a result, errors in installation of the studs 80 as well as lateral adjustment of a pilaster 16 easily can be accommodated. Adjuster nuts 82 and 84 simplify the task of adjusting the pilaster height (to account for pitch in the floor 22) and tilt angle.

Hinge structure for mounting a door panel 28 to a pilaster 16 is illustrated in FIGS. 6–10 and includes an elongated steel hinge plate 88 seated within a recess 90 (FIG. 2) intermediate the adjacent wall panels 58. The hinge plate 88 has a plurality of integral arms 92 which extend laterally outward and rearward of the pilaster 16. A cylindrical barrel 94 is formed at the distal end of each arm 92 and has a central opening and tapered upper end 95. A steel hinge plate 96 is adhesively secured to the back of the door panel 28 and has a plurality of integral arms 98 which each support a cylindrical barrel 100. Barrels 100 have a tapered lower end 102 which overlie the complementary taper on the upper end 95 of barrels 94 to form a self closing tendency in the hinge. Hinge pins 104 are inserted through aligned openings in the hinge barrels 94 and 100 and define a vertical axis about which the door panel 28 rotates, the hinge pins and barrels defining respective hinge forming members.

A rotary latch 106 is pivoted to the inside of the door panel 28 for selectively engaging a keeper 108 fastened to the inner most wall panel 58 of the pilaster 16. A striker plate 110 on the door panel 28 contacts a plurality of resilient bumper stops 112 on the pilaster 16 to absorb impact energy when the door is shut.

In addition to the many advantages discussed above as related to installation and operation, the cubicles 10 are particularly well adapted for use in moisture rich environments, such as shower and locker rooms. Features of the present construction which contribute to this versatile application still further distinguish the partition system of the present invention from the prior art.

Particularly, the partition system uniquely permits the use of wall panels 14 and 16 that are plastic and substantially impervious to moisture. The capability of using plastic panels provides many other advantages inherent with the composition of plastic. For instance, plastic panels are durable, easily cleaned and resistant to stain and thereby less susceptible to permanent defacing and vandalism. Plastic can be fabricated in a variety of aesthetically pleasing colors and textures to suit the needs of an interior designer. In one embodiment, the wall panels 14, door panels 28 and the panels 58 in the pilasters 16 are made of a filled acrylic polymer. In a preferred embodiment of the invention, panels of poly-methyl-methacrylate marketed under the trademark CORIAN® by DuPont De Nemours & Co. of Wilmington, Del. are utilized for the wall panels 14, the pilaster panels 58, and the door panels 28.

The robust, low stress connections defined by the adhesive connections in mounting means 20 and 26 in conjunction with the metal reinforcements defined by the U-channels 32 and 64, the pilaster reinforcing plate 60, the base plate 70, and the hinge plate 88 permit the use of CORIAN® panels in cost effective volumes without compromising the rigidity or structural integrity of the partition system. One working embodiment of the present invention successfully uses CORIAN® panels 14 and 58 having a thickness of about one-half (½) inches.

The design of the present partition system provides that those metallic reinforcing hardware components which are not inherently shielded within the pilaster 16 are uniquely adapted to being simply concealed by plastic trim components for rendering the cubicles essential invulnerable to the effects of humidity.

For instance, a pair of elongated plastic shrouds 114 (FIG. 4) are connected between the room wall 18 and the wall defining surfaces of the panels 14 and sealed thereto by means of silicon caulk or other suitably water resistant adhesive for encapsulating the U-channels 32 and 34 along with the threaded fasteners 36, the cap screws 38, the adjuster nuts 42 and 44, and the clamp nuts 52.

Plastic shrouds similar to the plastic shrouds 114 are provided along the forward edge 65 of the wall panels 14 for shielding the U-channels 64 and the cap screws 66 from contact with airborne moisture. The shrouds are adhesively secured to the pilaster panels 58 and to the wall panels 14 with silicon caulk.

Plastic boots 116 are located on the base of the pilasters 16 and are positioned over the foot 76 of the plates 74 to conceal the base plates, the bolt studs 80, and the nuts 82, 84, and 86. The boots 116 are adhesively secured to the pilaster panels 58 and to the floor 22 with silicon caulk.

Elongated plastic shrouds 118 (FIGS. 7 and 8) overlie the hinge plates 96 and are adhesively secured to the inside of the door panels 28 with silicon caulk.

In addition to utilization of the various water impervious shrouds and boots, durability of the metallic components is further enhanced in a preferred embodiment by fabricating the metal components from stainless steel.

Other improvements will also occur and should be understood to be within the spirit and scope of this invention, which is only to be limited by the following claims.

What is claimed is:

1. A partition system for defining one or more adjacent cubicles along a wall of a room, said system comprising a plurality of spaced partition forming structures, each including in combination:

a solid surface wall panel arranged to extend forwardly from and in substantially normal relation with the room wall, said wall panel having two opposed continuous wall forming surfaces extending between forward and rear edge portions of the wall panel;

a substantially vertical wall portion member supported on the floor of the room transversely of the wall panel and designed to hold the forward edge of said wall panel in spaced relation to the room floor;

a mounting assembly positively engaging the rear edge portion of said wall panel and rigidly securing said wall panel to the room wall, and including a pair of generally U-channel strips each having spaced legs interconnected by a web, the legs of one strip being engaged with the rear edge of the panel;

securing structure connecting the other strip to the wall at a location desired to place said panel with the legs of said other strip in supported contact along said wall; and an adjustable fastening structure rigidly interconnecting the webs of said strips so that the rear edge of said panel may be manipulated so as to assume a vertical orientation.

2. A partition system for defining one or more adjacent cubicles along a wall of a room having a floor, said system comprising a plurality of spaced partition forming structures, each including, in combination:

a wall panel made of solid surface material, said wall panel having two opposed continuous wall forming surfaces extending between forward and rear edge portions thereof;

said panel having a plurality of spaced access openings along at least the rear edge thereof;

an upright wall portion member mounted in spaced relation to said wall, said wall portion member being constructed and arranged to support the forward edge of said wall panel in spaced relation to the floor;

a mounting structure attaching the forward edge of said panel to said wall portion member;

adjustable fastening structure attached to the rear edge of said panel for securing the panel to the wall, comprising:

first and second U-channel strips each having legs interconnected by a web;

said first strip being adhesively engaged over the rear edge portion of said wall panel to provide positive engagement with the respective wall forming surfaces along the length of the U-channel;

the web of said first strip having a plurality of fastener receiving openings arranged in spaced relation therealong for alignment with said access openings along said rear edge of said panel;

securing structure connecting said second strip to the wall at a location desired to place said panel with the legs of said second strip in supported contact along said wall with the web facing outwardly from the wall;

the web portion of said second strip having a plurality of spaced fastener receiving openings spaced therealong aligned with the corresponding openings of said first strip; and adjustable fasteners attached to and extending between the webs of said first and second strips for rigidly interconnecting the webs of said strips, said fasteners being constructed to be adjustable so that said first strip and the rear edge of said panel may be supported in a substantially vertical position.

3. The partition system as in claim 2 further including an elongated solid surface shroud extending vertically along each side of the wall panel at the rear edge thereof for substantially concealing the U-channel strips.

4. The partition system of claim 2 in which the wall panel is made of methyl methacrylate.

5. The partition system of claim 2 in which the wall panel has a thickness equal to approximately one-half inch.

6. The partition system as in claim 2 further in which said wall portion member comprises a composite structure having a pair of adjacent upright solid surface panels and at least one metal plate disposed therebetween for reinforcing said wall portion member, said plate having a plurality of openings therein for receiving fasteners.

7. The partition system as in claim 6 further in which said mounting assembly comprises a metal U-channel having a pair of spaced legs adhesively secured to the surfaces of said wall panel and a web portion extending between the legs, the forward edge portion of the wall panel having a plurality of spaced apart access openings, and the web portion of the U-channel having a plurality of spaced fastener receiving openings each aligned with a corresponding one of said access openings, and a plurality of fasteners extending through said openings in said web and into said fastener receiving openings in said at least one plate for rigidly securing the U-channel strip and panel to said wall portion member.

8. The partition system as in claim 7 including an elongated solid surface shroud mounted to extend along each side of the wall panel at the forward edge thereof and in contact with said wall portion member for substantially concealing the U-channel and access openings in said panel.

9. The partition system as in claim 2 further in which:

said wall portion member is supported on the floor transversely of said wall panel, said wall portion member having a pair of adjacent solid surface panels and at least one metal reinforcing plate extending internally through at least a portion of the height of said wall portion member, said at least one reinforcing plate having an exposed lower end terminating beneath said adjacent solid surface panels and further including;

an engagement assembly rigidly securing the exposed lower end of said reinforcing plate to a threaded end of one or more bolts which extend upwardly from said floor, said engagement assembly including a footer plate integral with the exposed lower end of said reinforcing plate and having an opening for receiving respective distal ends of said bolts and retaining nuts for engaging the respective bolts and locating the footer plate relative to the floor.

10. The partition system as in claim 9 including a solid surface door panel and a hinge structure for mounting the door panel to the wall portion member for rotation about a vertical axis so that the door panel is used to selectively control access through an opening defined between a pair of adjacent wall portion members, said hinge structure including a first metal hinge plate substantially concealed in the wall portion member between said pair of adjacent solid support panels, said first hinge plate having a plurality of spaced integral arms which extend outwardly of the wall portion member and toward the opening, and a second metal hinge plate secured to one surface of said door panel and having a plurality of spaced integral arms which extend away from said door panel and toward the first hinge plate, and a plurality of hinge forming members rotatably interconnecting each arm on the first hinge plate with one of the arms on the second hinge plate.

11. A partition system as in claim 2, further including:

at least two spaced apart wall portion members defining a cubicle opening therebetween;

a solid surface door panel; and a hinge structure for mounting the door panel to one of the wall portion members for rotation about a vertical axis, said hinge structure including a first elongate metal hinge plate mounted and substantially enclosed between a pair of adjacent panels forming said wall portion member, said first hinge plate having a plurality of spaced integral hinge arms which extend outwardly of the wall portion member and toward the cubicle opening, and a second elongate metal hinge plate secured to a surface of said door panel and having a plurality of spaced integral hinge arms which extend away from said door panel and toward the first hinge plate, and a plurality of hinge forming members for rotatably interconnecting each hinge arm on the first hinge plate with one of the arms on the second hinge plate to form connected hinges therebetween.

12. The partition system as in claim 11 including an elongated plastic shroud extending vertically along said surface of said door panel for concealing the second hinge plate.

13. The partition system as in claim 2 in which said wall portion member comprises a composite structure having a pair of adjacent upright solid surface panels and one or more metal plates disposed therebetween for reinforcing said wall portion member without exposing said reinforcing plates.

14. The partition system of claim 13 in which the wall portion member panels are made of methyl methacrylate.

15. The partition system of claim 13 in which each wall portion member panel has a thickness equal to approximately one-half inch.

16. A partition system for defining a cubicle along a vertical wall of a room, said system comprising;

first and second spaced partition forming structures, each partition forming structure including in combination;

a solid surface wall panel arranged to extend forwardly from and in substantially normal relation with the vertical room wall;

means for rigidly securing a rear vertical edge of said wall panel to the room wall;

a composite pilaster having a pair of adjacent upright solid surface panels extending transversely of said wall panel and a metal reinforcing plate extending internally through at least a portion of the height of said pilaster for holding the forward edge of said wall panel in spaced relation to the room floor, the composite pilasters of a pair of adjacent partition forming structures defining a cubicle opening therebetween;

a solid surface door panel; and a hinge structure for mounting the door panel to a composite pilaster for rotation about a vertical axis so that the door panel is used to selectively control access through said opening, said hinge structure including a first elongate metal hinge plate mounted and substantially enclosed between a pair of adjacent panels in said composite pilaster, said first hinge plate having a plurality of spaced integral hinge arms which extend outwardly of the composite pilaster and toward the opening, and a second elongate metal hinge plate secured to a surface of said door panel and having a plurality of spaced integral hinge arms which extend away from said door panel and toward the first hinge plate, and means for rotatably interconnecting each hinge arm on the first hinge plate with one of the arms on the second hinge plate to form connected hinges therebetween.

17. The partition system as in claim 16 including an elongated plastic shroud extending vertically along said surface of said door panel for substantially enclosing the second hinge plate.

18. A partition system for defining one or more adjacent cubicles along a vertical wall of a room, said system comprising a plurality of spaced partition forming structures, each including in combination:

a solid surface plastic wall panel arranged to extend forwardly from and in substantially normal relation with the vertical room wall, said wall panel having two opposed continuous wall forming surfaces extending between forward and rear edge portions of the wall panel;

a pilaster supported on a floor of the room transversely of the wall panel and designed to hold the forward edge of said wall panel in spaced relation to the room floor;

mounting means for positively engaging the rear edge portion of said wall panel for rigidly securing said wall panel to the room wall;

said mounting means including a pair of U-channel strips each having legs interconnected by a web, the legs of one strip being attached to the rear edge of the panel;

means for securing the other strip to the wall at a location desired to place said panel with the legs of said other strip in supported contact along said wall; and adjustable means for rigidly interconnecting the webs of said strips so that the rear edge of said panel may be manipulated to assume a vertical orientation, said means comprising a plurality of cap screws for abutting one of said strips and a pair of nuts positioned on said screw for embracing said other strip.

19. A partition system for defining one or more adjacent cubicles along a vertical wall of a room including a floor, said system comprising a plurality of spaced partition forming structures, each including in combination:

a solid surface plastic wall panel arranged to extend forwardly from and in substantially normal relation with the vertical room wall, said wall panel having two opposed continuous wall forming surfaces extending between forward and rear edge portions of the wall panel;

a pilaster supported on the floor of the room transversely of the wall panel and designed to hold the forward edge of said wall panel in spaced relation to the room floor;

mounting means for positively engaging the rear edge portion of said wall panel for rigidly securing said wall panel to the room wall;

said mounting means including first and second metal U-channel strips each having legs interconnected by a web;

said wall panel having a substantially rectangular cross section and said first metal U-channel strip being adhesively secured over the rear edge portion of said wall panel to provide positive engagement with the wall panel along the length of the first metal U-channel strip without interrupting or penetrating either of said wall forming surfaces of the wall panel;

said first metal U-channel strip embracing the opposite sides of said wall panel and the web portion extending between the legs, the web portion of said first metal U-channel strip having a plurality of spaced fastener receiving openings for mounting said first metal U-channel strip and panel from said wall;

said second metal U-channel strip having a pair of spaced legs for contacting the wall with said web portion extending between the legs and having a plurality of spaced fastener receiving openings therein;

means for securing the second metal U-channel strip to the wall at a location desired to place said panel with the legs of said second metal U-channel strip in supported contact along said wall; and adjustable means for rigidly interconnecting the webs of said strips via said fastener receiving openings so that the rear edge of said panel may assume a vertical orientation.

* * * * *